US009373273B2

(12) United States Patent
Engelby et al.

(10) Patent No.: US 9,373,273 B2
(45) Date of Patent: Jun. 21, 2016

(54) MARKETING INFORMATION DISPLAY ASSEMBLY

(71) Applicant: Target Brands, Inc., Minneapolis, MN (US)

(72) Inventors: Daniel G. Engelby, Andover, MN (US); Kimberly D. Sales, Minneapolis, MN (US)

(73) Assignee: Target Brands, Inc., Minneapolis, MN (US)

( * ) Notice: Subject to any disclaimer, the term of this patent is extended or adjusted under 35 U.S.C. 154(b) by 308 days.

(21) Appl. No.: 14/070,091

(22) Filed: Nov. 1, 2013

(65) Prior Publication Data

US 2014/0197923 A1 Jul. 17, 2014

Related U.S. Application Data

(60) Provisional application No. 61/752,749, filed on Jan. 15, 2013.

(51) Int. Cl.
*G09F 3/20* (2006.01)
*G09F 1/04* (2006.01)

(52) U.S. Cl.
CPC *G09F 3/208* (2013.01); *G09F 1/04* (2013.01); *G09F 3/203* (2013.01); *Y10T 29/49002* (2015.01)

(58) Field of Classification Search
CPC ..... G09F 3/204; G09F 3/208; A47F 5/00
See application file for complete search history.

(56) References Cited

U.S. PATENT DOCUMENTS

| | | | |
|---|---|---|---|
| 2,859,546 | A | 11/1958 | Gutterson |
| 3,530,605 | A | 9/1970 | Gutterson |
| 3,711,973 | A | 1/1973 | Slavsky |
| 4,141,529 | A | 2/1979 | Casutt |
| 4,485,575 | A | 12/1984 | Fast |
| D353,627 | S | 12/1994 | McCormick |

(Continued)

FOREIGN PATENT DOCUMENTS

| | | | |
|---|---|---|---|
| JP | 2004013165 | A * | 1/2004 |
| JP | 2004361729 | A * | 12/2004 |

(Continued)

OTHER PUBLICATIONS

Office Action from Canadian Patent Application No. 2,832,068, mailed May 15, 2014 (3 pages).

(Continued)

*Primary Examiner* — Cassandra Davis
(74) *Attorney, Agent, or Firm* — Leanne Taveggia Farrell; Westman, Champlin & Koehler, P.A.

(57) ABSTRACT

An assembly includes an electronic price label having an outer casing, a cover attached to the electronic price label and a marketing sign that highlights the electronic price label. The outer casing of the electronic price label module houses a display screen and circuitry for sending and receiving data signals over a network. The cover includes a front panel having a window. The window exposes the display screen of the electronic price label and a sensor on the electronic price label that sends and receives the data signals over the network. The marketing sign includes an opening defined by a perimeter. The perimeter surrounds the outer casing of the electronic price label and at least a portion of the marketing sign is located behind the front panel of the cover.

20 Claims, 7 Drawing Sheets

(56) References Cited

U.S. PATENT DOCUMENTS

| | | | | |
|---|---|---|---|---|
| 5,682,698 | A | 11/1997 | Bevins | |
| 5,709,297 | A | 1/1998 | Brandriff et al. | |
| 5,967,343 | A | 10/1999 | Dufresne | |
| 6,279,256 | B1 | 8/2001 | Norolof et al. | |
| 6,354,546 | B1 | 3/2002 | Mueller | |
| 6,367,752 | B1 | 4/2002 | Forsythe et al. | |
| 6,411,196 | B1 * | 6/2002 | Bhyravabhotla | G06Q 30/06 340/5.91 |
| 6,651,369 | B1 | 11/2003 | Keating et al. | |
| D511,547 | S | 11/2005 | Andersson et al. | |
| 7,055,274 | B2 | 6/2006 | Fast et al. | |
| 7,278,231 | B2 * | 10/2007 | Lowry | G09F 3/204 206/462 |
| 7,992,334 | B1 * | 8/2011 | Engelby | G09F 3/202 40/124.05 |
| 8,356,436 | B2 | 1/2013 | Horikiri | |
| 2011/0239509 | A1 | 10/2011 | Horikiri | |
| 2011/0286195 | A1 | 11/2011 | Horikiri et al. | |
| 2012/0023797 | A1 | 2/2012 | Rosander et al. | |
| 2014/0158846 | A1 * | 6/2014 | Nicolis | G09F 3/204 248/309.1 |

FOREIGN PATENT DOCUMENTS

| | | | | |
|---|---|---|---|---|
| JP | 2005040334 | A * | 2/2005 | |
| JP | 2010110506 | A * | 5/2010 | |
| JP | 2011197395 | A * | 10/2011 | |
| WO | WO 2010052994 | A1 * | 5/2010 | G09F 3/204 |

OTHER PUBLICATIONS

Office Action from Canadian Patent Application No. 2,832,068, mailed Jan. 19, 2015 (4 pages).

Office Action from Canadian Patent Application No. 2,832,068, mailed Jan. 21, 2014 (2 pages).

* cited by examiner

MARKETING INFORMATION DISPLAY ASSEMBLY

CROSS-REFERENCE TO RELATED APPLICATION

The present application is based on and claims the benefit of U.S. provisional patent application Ser. No. 61/752,749, filed Jan. 15, 2013, the content of which is hereby incorporated by reference in its entirety.

BACKGROUND

Electronic price labels (EPLs) are electronic display modules that are attached to fronts of display structures in retail stores. The electronic display modules include display screens that can use LCD or other display technology to display the current product price. The EPLs also include circuitry for sending and receiving data signals over a network. Such data communication allows the EPLs to be automatically updated whenever the product price changes. The network can communicate using radio, infrared or other communication signals, which reduce costs related to managing and displaying accurate prices.

SUMMARY

An assembly includes an electronic price label having an outer casing, a cover attached to the electronic price label and a marketing sign that highlights the electronic price label. The outer casing of the electronic price label module houses a display screen and circuitry for sending and receiving data signals over a network. The cover includes a front panel having a window. The window exposes the display screen of the electronic price label and a sensor on the electronic price label that sends and receives the data signals over the network. The marketing sign includes an opening defined by a perimeter. The perimeter surrounds the outer casing of the electronic price label and at least a portion of the marketing sign is located behind the front panel of the cover.

The marketing sign further includes a main section having the opening that is spaced apart from a top edge of the marketing sign and spaced apart from a bottom edge of the marketing sign. The marketing sign also includes a balloon section coupled to the main section by a bend. The balloon section is oriented out-of-plane from the main section and has indicia highlighting a retail product.

A method of assembling a marketing information display assembly includes mounting a marketing sign holder to the outer casing of the electronic price label. An edge of the marketing sign is inserted into the channel in the marketing sign holder. The edge of the marketing sign defines a portion of the opening in the main section of the marketing sign. A remainder of the marketing sign is pushed to slide over the marketing sign holder so that the marketing sign surrounds at least the outer casing of the electronic price label module.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION OF DRAWINGS

DETAILED DESCRIPTION

Often retailers desire to highlight certain products that are being displayed for sale. For example, a retailer may want to bring certain products in a retail store to the attention of the customer because they were advertised in a certain media format or have characteristics not possessed by similarly displayed products, such as products that are on sale or products that offer promotional incentives.

Marketing signs are signs that enhance the visual appearance of existing price labels or price label holders for a product. While price labels can be printed versions that are attached to a front of a display structure, embodiments described below include an electronic price label (EPL). In other words, embodiments described below include a marketing sign supported by a marketing sign holder or cover, which is attached to an EPL to highlight the product that the EPL is displaying pricing information about.

EPLs are electronic display modules that are attached to fronts of display structures in retail stores. For example, an EPL can be attached to a front of a shelf in a retail store. Each EPL includes a display screen that uses, for example, LCD or other display technology to display the current product price. Each EPL also includes a power source, communication circuitry for sending and receiving data signals over a network and memory circuitry to store images to be displayed. The circuitry allows the EPL to be automatically updated with product price changes. For example, the network can communicate product price changes using radio, infrared or other communication signals, which reduce costs related to managing and displaying accurate prices.

The marketing sign holder or cover that attaches to an EPL includes a single, continuous piece of material that forms a frame having a center opening or window. At least a portion of the frame of the marketing sign holder or cover mates with at least a portion of an EPL, and at least another portion of the frame (that is different from the portion(s) of the frame that mate with the EPL) engages with a marketing sign for highlighting the products for which the EPL is displaying a product price.

Figure 1:
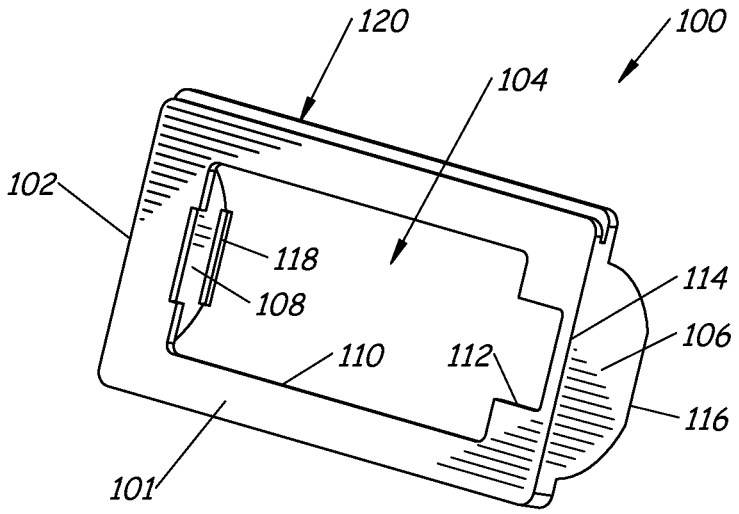
FIG. 1 is a front perspective view of a marketing sign holder according to one embodiment.
Figure 2:
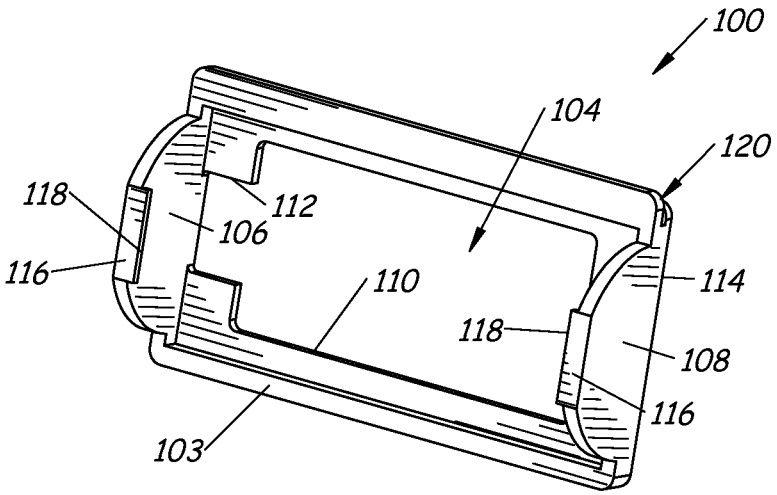
FIG. 2 is a back perspective view of the marketing sign holder illustrated in FIG. 1.
Figure 3:
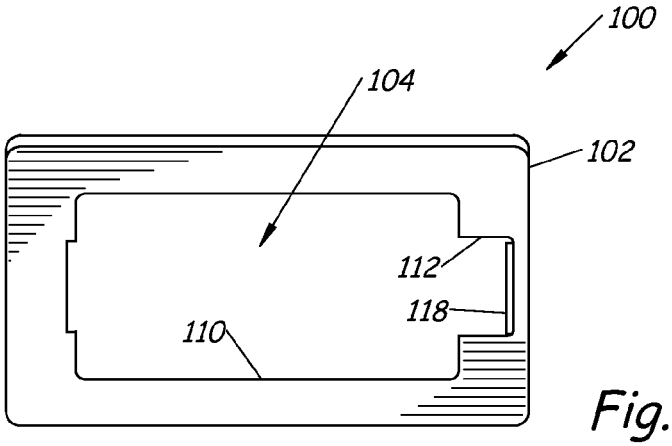
FIG. 3 is a front view of the marketing sign holder illustrated in FIG. 1.
Figure 4:
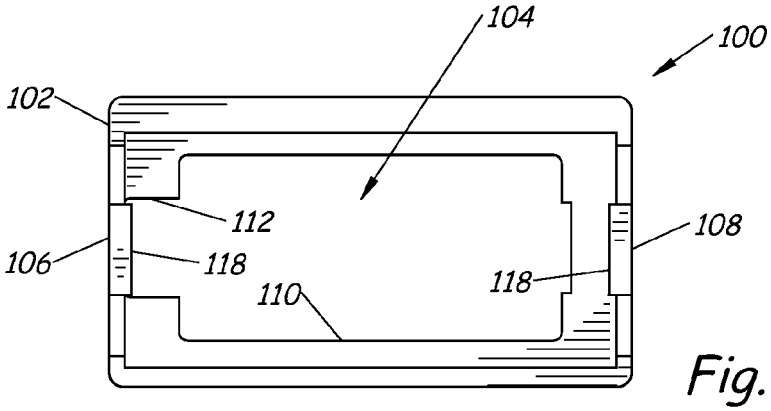
FIG. 4 is a back view of the marketing sign holder illustrated in FIG. 1.
Figure 5:
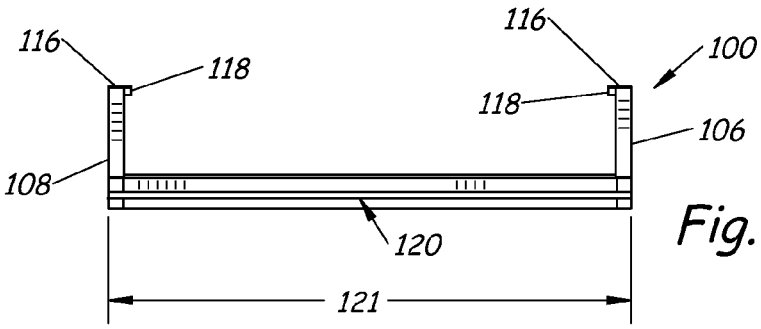
FIG. 5 is a top view of the marketing sign holder illustrated in FIG. 1.
Figure 6:
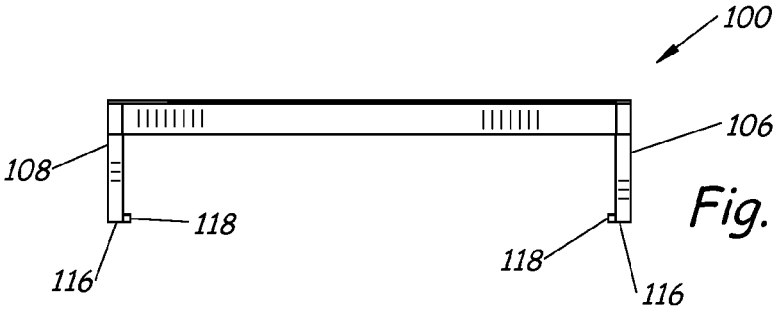
FIG. 6 is a bottom view of the marketing sign holder illustrated in FIG. 1.
Figure 7:
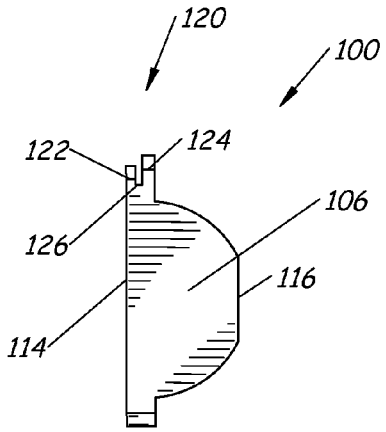
FIG. 7 is a side view of the marketing sign holder illustrated in FIG. 1, the opposing side being a mirror image.

FIG. 1 is a front perspective view, FIG. 2 is a back perspective view, FIG. 3 is a front view, FIG. 4 is a back view, FIG. 5 is a top view, FIG. 6 is a bottom view and FIG. 7 is a side view of a marketing sign holder or cover 100 according to one embodiment. Marketing sign holder 100 is made of a continuous piece of material and includes a front panel 102 having a front face 101 and a back 103, a center opening or window 104 extending through front panel 102 and a pair of side panels 106 and 108. The continuous piece of material of the frame of marketing sign holder 100 can be made of a polymer, such as polystyrene. In some embodiments, the continuous piece of material of the frame of marketing sign holder 100 can be made of a colored polymer so as to more effectively highlight the EPL to which it will be or is attached.

Center opening or window 104 is spaced apart from a top edge of front panel 102, spaced apart from a bottom edge of front panel 102 and spaced apart from side edges of front panel 102. In addition, center opening or window 104 includes a display portion 110 and a sensor portion 112. Display portion 110 is a portion of center opening or window 104 that exposes a display screen of an EPL when marketing sign holder 100 is mounted to the EPL. Sensor portion 112 is a portion of center opening or window 104 that exposes a sensor of the EPL when marketing sign holder 100 is mounted to the EPL. By exposing the sensor of the EPL, the sensor can receive and send data communication signals.

Figure 8:
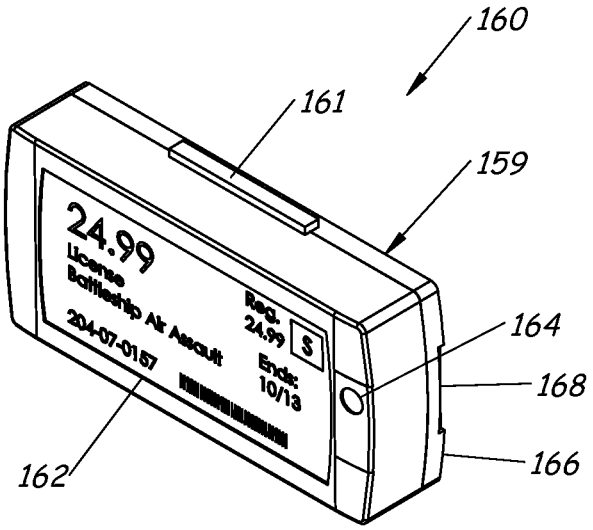
FIG. 8 is a top, front perspective view of an exemplary electronic price label (EPL).
Figure 9:
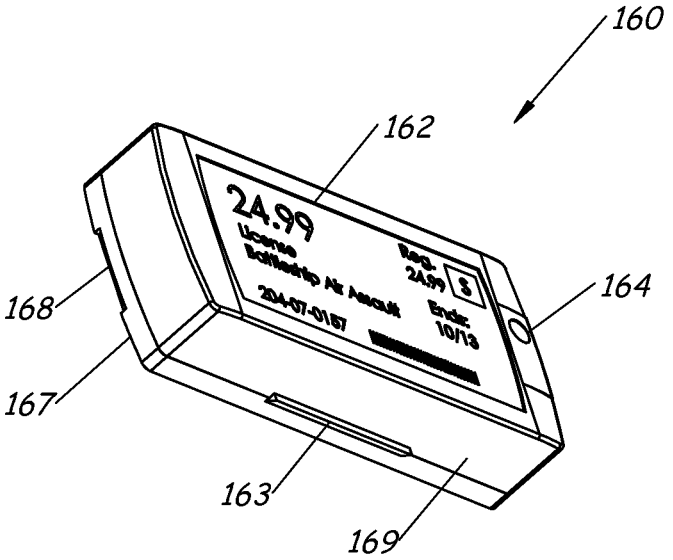
FIG. 9 is a bottom, front perspective view of the exemplary electronic price label (EPL) illustrated in FIG. 8.

An exemplary EPL 160 is illustrated in FIGS. 8 and 9. FIG. 8 is a top, front perspective view of EPL 160, and FIG. 9 is a bottom, front perspective view of EPL 160. EPL 160 includes a two-piece outer casing 159 that includes a top hinge 161 as illustrated in FIG. 8 and a bottom lip 163 as illustrated in FIG. 9. Bottom lip 163 snap-locks the two-piece outer casing 159 together and also provides a thumb or finger grip for prying the two-piece outer casing 159 apart. Inside the two-piece outer casing 159 is a display screen 162, a sensor 164 and other components and circuitry for operating EPL 160. With reference back to marketing sign holder 100, display portion 110 of window 104 is configured to expose display screen 162, while sensor portion 112 of window 104 is configured to expose sensor 164 when marketing sign holder or EPL cover 100 is mounted to EPL 160.

Side panels 106 and 108 of marketing sign holder 100 include fixed ends 114 and free ends 116. Fixed ends 114 are fixed to front panel 102. Free ends 116 are positioned distally from front panel 102 and each include a lip 118. Each lip 118 protrudes inwardly from a free end 116 of one of side panels 106 and 108 and is configured to mate or engage with a side of the outer casing of an EPL. With reference back to FIGS. 8 and 9, exemplary outer casing 159 of EPL 160 includes a back right side edge 166 and a back left side edge 167. Back right side edge 166 and the back left side edge 167 include notches or grooves 168. Lip 118 of side panel 106 is configured to mate with or engage with notch 168 on back right side edge 166 and lip 118 of side panel 108 is configured to mate with or engage with notch 168 on back left side edge 167 of EPL 160. Marketing sign holder 100 is fully engaged with EPL 160 when each lip 118 snaps into engagement with each notch 168 in EPL 160.

Front panel 102 includes a channel 120 having an open top and located on a top of front panel 102. Channel 120 extends across at least a portion of width 121 of front panel 102 and, as illustrated in FIG. 7, is defined by a first leg 122, a second leg 124 and a support surface (or bottom of the channel) 126 that couples the first leg 122 to the second leg 124. First leg 122 extends upwardly from support surface 126 and is located closer to front face 101 of front panel 102 than second leg 124. Second leg 124 also extends upwardly from support surface 126, but is located closer to back 103 of front panel 102 than is first leg 122. In one embodiment, the pair of legs 122 and 124 extend substantially normal to support surface 126 and support surface 126 is oriented substantially normal to front face 101 of front panel 102. As illustrated in FIG. 7, second leg 124 extends upwardly from support surface 126 a greater distance than the distance with which first leg 122 extends upward from support surface 126. Together, first leg 122, second leg 124 and support surface 126 provide channel 120 with an open top for receiving a portion of a marketing sign.

Figure 10:
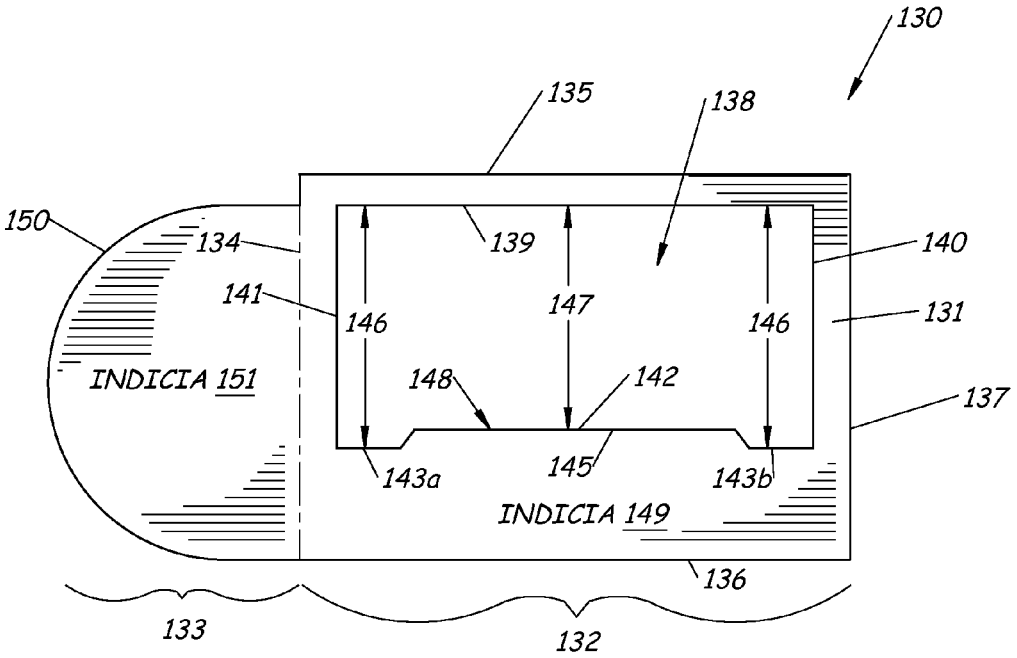
FIG. 10 is a plan view of a marketing sign according to one embodiment.

FIG. 10 illustrates a plan view of a marketing sign 130 according to one embodiment. Marketing sign 130 is configured to be used to enhance or highlight an EPL, such as EPL 160, while the EPL is being supported on a display structure. Marketing sign 130 includes a front surface 131 and is made with a pliable yet resilient sheet material, such as cardboard, or other rigid material, such as a polymeric material. Marketing sign 130 can be manufactured with a variety of different types of punch and die machines and/or laser machines.

Marketing sign 130 includes a main section 132 and a balloon section 133 that is coupled to main section 132 by a bend 134. In one embodiment, bend 134 is a weakened area or line, such as a score line or continuous groove formed in the sheet material that extends from a top edge 135 of marketing sign 130 to a bottom edge 136 of marketing sign 130. However, other types of bends are possible. For example, bend 134 can be a weakened area formed with a line of perforations or can be a bend formed from applying a heat treatment in the instance where marketing sign 130 is made of a polymeric material.

Main section 132 is defined by bend 134, top edge 135, bottom edge 136 and a side edge 137 and includes an opening or window 138 defined by a perimeter or perimeter edge. The perimeter of opening 138 is configured to surround at least electronic price label module 160. The perimeter includes a top edge 139, opposing right side edge 140 and left side edge 141 and a bottom edge 142. Top edge 139 of the perimeter is substantially parallel with top edge 135 of main section 132 and is spaced apart from top edge 135 of main section 132. Right side edge 140 and left side edge 141 of the perimeter are substantially parallel with each other and also substantially parallel with side edge 137 of main section 132. Right side edge 140 of the perimeter is spaced apart from side edge 137 of main section 132 and left side edge 141 of the perimeter is spaced apart from bend 134.

While all portions of bottom edge 142 are continuous, there are portions of bottom edge 142 that are substantially parallel with bottom edge 136 of main section 132 and portions of bottom edge that are not substantially parallel with bottom edge 136 of main section 132. Bottom edge 142 includes a tab portion 145 that protrudes from two main portions 143*a* and 143*b* located on either side of tab portion 145. Main portions 143*a* and 143*b* are in alignment with each other and substantially parallel with bottom edge 136 of main section 132. Tab portion 145 is not in alignment with main portions 143*a* and 143*b*, but is substantially parallel with bottom edge 136.

Opening 138 includes a height 146 that extends between top edge 139 and main portions 143*a* and 143*b* of bottom edge 136. Opening 138 also includes a height 147 that extends between top edge 139 and tab portion 145 of bottom edge 136. Height 146 is greater than height 147. Since bottom edge 142 is a continuous edge, main portion 143*a* connects with tab portion 145 by a portion of bottom edge 142 that is not substantially parallel with bottom edge 136 of main section 132 and tab portion 145 connects with main portion 143*b* by a portion of bottom edge 142 that is not substantially parallel with bottom edge 136 of main section 132. In other words, main section 132 of marketing sign 139 includes a tab 148 defined by tab portion 145 and the portions of bottom edge 142 that are not substantially parallel with bottom edge 136 of main section 132 so that tab 148 protrudes into opening 138.

Main section 132 also includes indicia 149 located below opening 138. Indicia 149 includes information that describes the reason that the EPL, such as EPL 160, is to be highlighted. For example, indicia 149 can describe the price shown on the EPL as being a price that is a sale price or as an "as advertised" price as found in a mailer or other promotional advertisement.

Balloon section 133 is defined by bend 134 and a curved edge 150. Balloon section 133 of marketing sign 130 can be bent or oriented out-of-plane from main section 132 along bend 134 to further gain the attention of the customer in a retail store. Such a bend is illustrated in FIGS. 11, 13, 14 and 15. Balloon section 133 includes indicia 151. In one embodiment, indicia 151 matches indicia 149 on main section 132 and describes the reason that the EPL, such as EPL 160, is highlighted. For example and as described in the above example for indicia 149, indicia 151 can describe the price on the EPL as being a sale price or an "as advertised" price as found in a mailer or other promotional advertisement.

Figure 11:
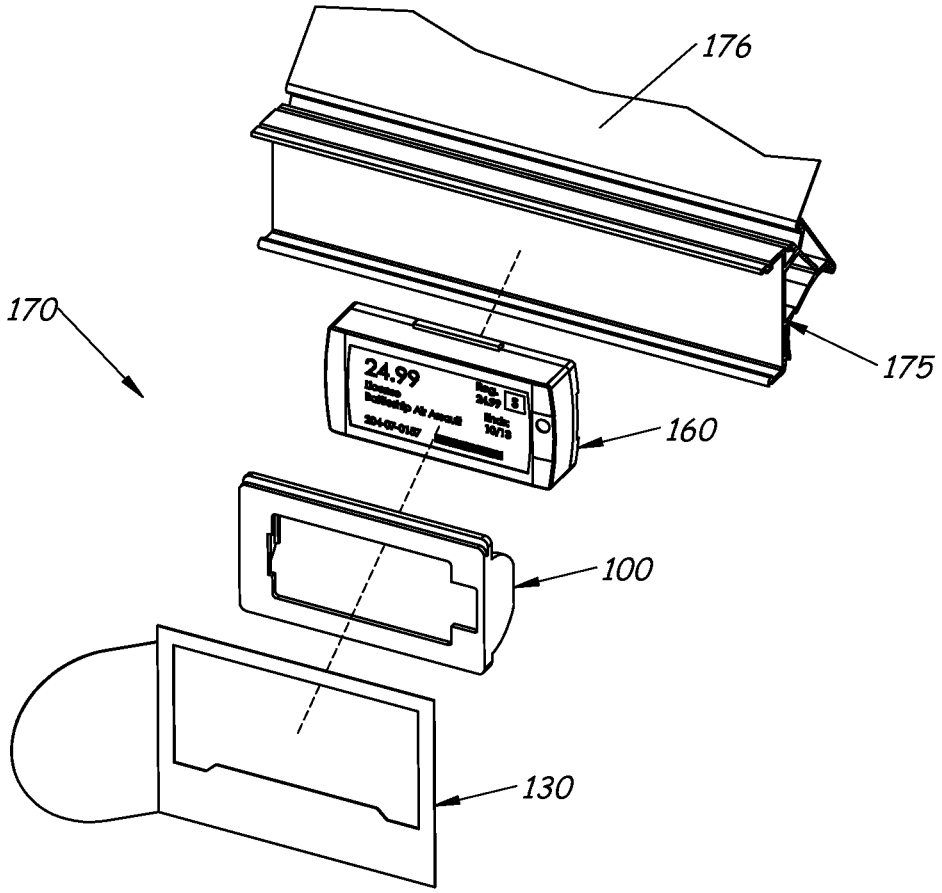
FIG. 11 is an exploded perspective view of a marketing information display assembly including the marketing sign of FIG. 10, the marketing sign holder of FIG. 1 and an electronic price label (EPL) of FIG. 8 according to one embodiment.
Figure 12:
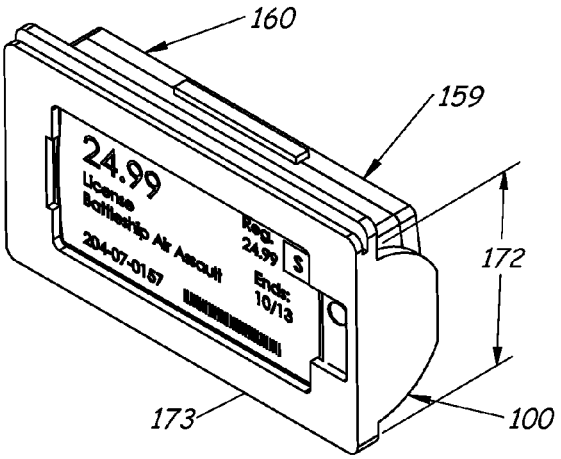
FIG. 12 is a perspective view of the assembled EPL and marketing sign holder.

FIG. 11 illustrates an exploded perspective view of a marketing information display assembly 170 including marketing sign 130 of FIG. 10, marketing sign holder or cover 100 of FIG. 1 and electronic price label (EPL) 160 of FIGS. 8 and 9 according to one embodiment. To assemble marketing information display assembly 170, marketing sign holder or cover 100 is first mounted to outer casing 159 of EPL 160 as illustrated in the FIG. 12 perspective view. As discussed above, lip 118 of side panel 106 is configured to mate with or engage with notch 168 on back right side edge 166 of outer casing 159 of EPL 160 in a press-fit arrangement and lip 118 of side panel 108 is configured to mate with or engage with notch 168 on back left side edge 167 of outer casing 159 of EPL 160 in a press-fit arrangement. Marketing sign holder or cover 100 is fully engaged with EPL 160 when each lip 118 snaps into engagement with each notch 168 in outer casing 150 of EPL 160.

Figure 15:
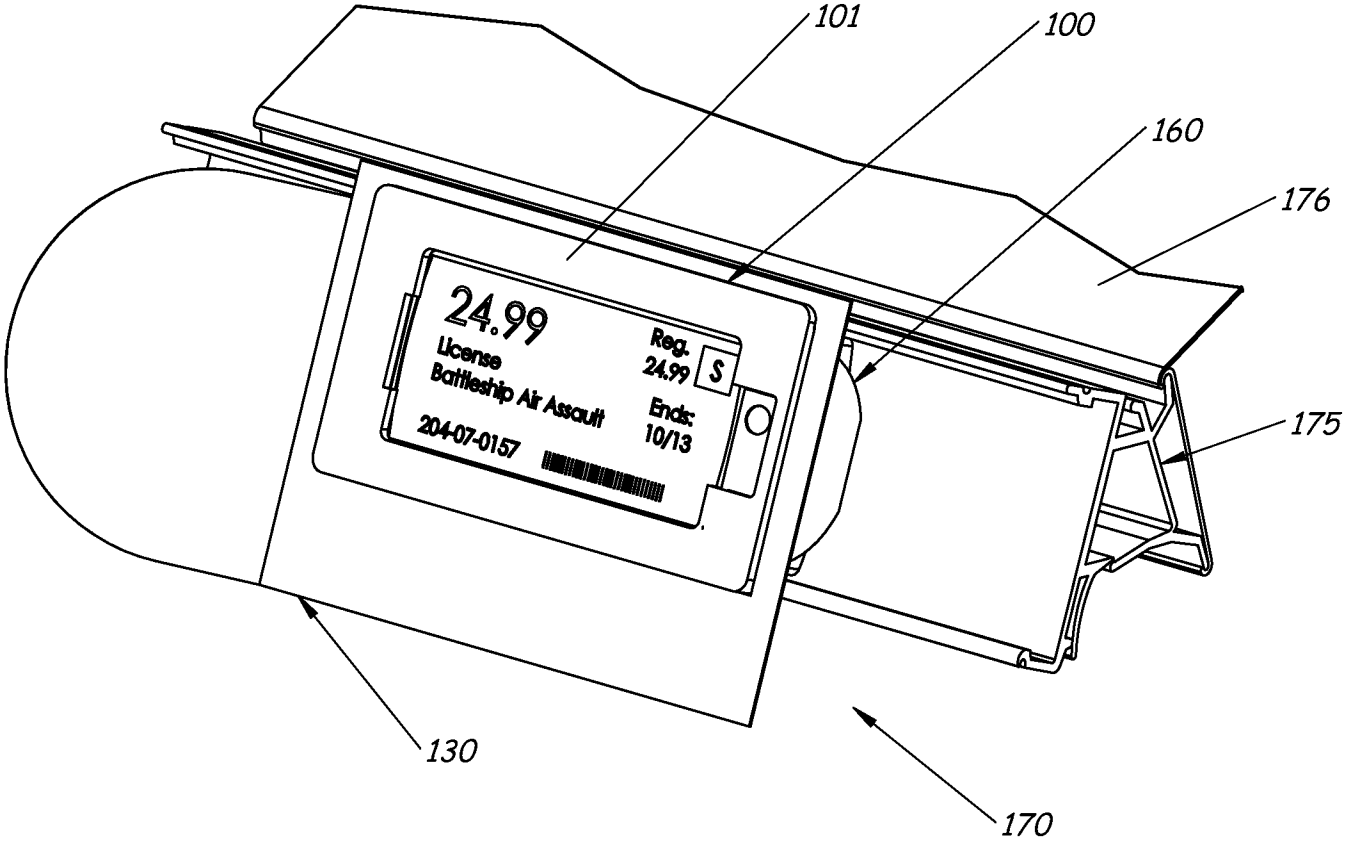
FIG. 15 is a perspective view of a marketing information display assembly including the marketing sign, the marketing sign holder and the EPL, which were illustrated in an exploded view in FIG. 11.

Next, the assembled marketing sign holder 100 and EPL 160 are mounted to a display fixture, such as an extruded channel 175 (FIGS. 11 and 15), which is attached to a front of a shelf 176 (FIGS. 11 and 15). Although not specifically illustrated, EPL 160 is secured to extruded channel 175 using top hinge 161 and bottom lip 163.

Figure 13:
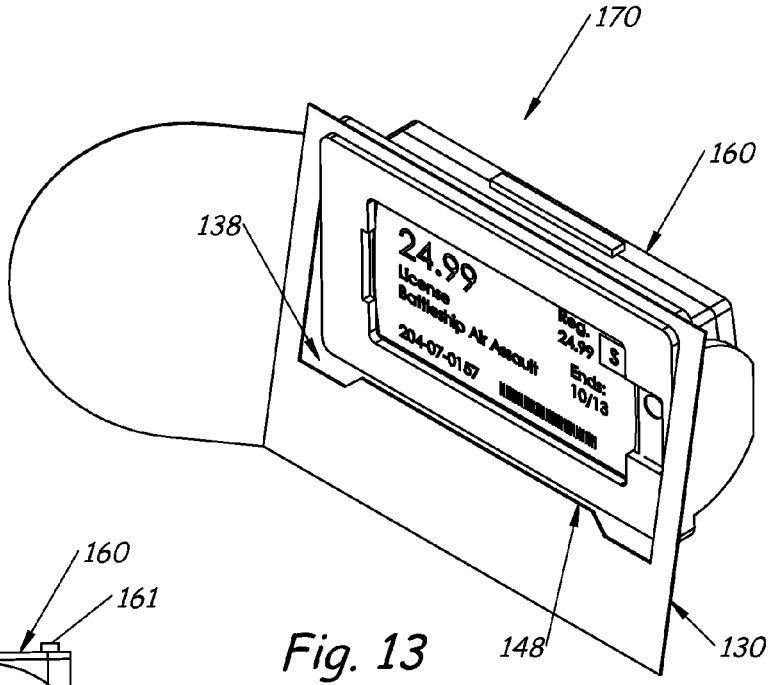
FIG. 13 is a perspective view of the marketing sign partially assembled to the assembled EPL and the marketing sign holder.

After assembled marketing sign holder 100 and EPL 160 are mounted to a display fixture, marketing sign 130 is engaged or mated with marketing sign holder 100 as illustrated in FIG. 13. In this way, marketing sign 130 can be attached to or detached from EPL 160 without removing marketing sign holder 100 and EPL 160 from the display fixture. To attach marketing sign 130, top edge 139 of opening 138 in marketing sign 130 is inserted into channel 120 of marketing sign holder 100. More specifically, top edge 139 of opening 138 in marketing sign 130 engages with or contacts support surface 126 and rests between first leg 122 and second leg 124 of channel 120. Because height 147 of opening 138, which extends between top edge 139 and tab portion 145 of bottom edge 136, is less than a height 172 (FIG. 12), which extends between support surface 126 and a bottom 173 (FIG. 12) of marketing sign holder 100, tab 148 or tab portion 145 is located forward of front panel 102 when top edge 139 is initially inserted into channel 120 or engaged with support surface 126 as illustrated in FIG. 13.

Figure 14:
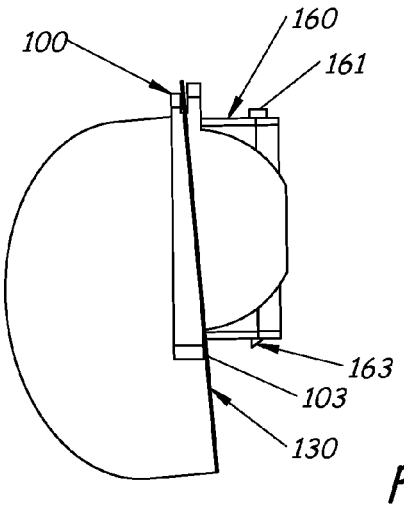
FIG. 14 is a side view of the marketing sign assembled to the assembled EPL and marketing sign holder.

As illustrated in FIG. 14, to complete the attachment of marketing sign 130 to the assembled marketing sign holder 100 and EPL 160, tab 148 and the remainder of marketing sign 130 including bottom edge 136 of marketing sign 130 are pushed so that tab 148 bends forward to slide over bottom 173 of front panel 102 and then at least partially unbends after it clears bottom 173 so that tab 148 rests against back 103 of marketing sign holder 100. While height 147 is less than height 172, height 147 is greater than a distance between support surface 126 and a bottom 169 (FIG. 9) of outer casing 159 of EPL 160 when EPL 160 is assembled to marketing sign holder 100. As a result, when assembled, tab 148 is located between marketing sign holder 100 and bottom lip 163 or the display fixture to which EPL 160 is mounted.

FIG. 15 is an assembled perspective view of the marketing information display assembly 170 including marketing sign 130, marketing sign holder or cover 100 and the EPL 160, which were illustrated as exploded in FIG. 11. In addition, FIG. 15 illustrates extruded channel part 175, which is attached to the front of shelf 176 in a retail store. Extruded channel part 175 is configured to receive and secure EPL 160 even while marketing sign holder 100 is mounted thereto. For example, a portion of EPL 160 can be press fit into or otherwise attached to extruded channel part 175. As illustrated in FIG. 15, the perimeter of opening 138 in main section 132 of marketing sign 130 surrounds outer casing 159 of EPL 160. Balloon section 133 is bent or oriented out-of-plane from main section 132 and therefore also oriented out-of-place from front face 101 of marketing sign holder 100 to gain the attention of a customer whether the customer is looking at the shelf straight on or from either side.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. An assembly comprising:

an electronic price label having an outer casing that houses a display screen and circuitry for sending and receiving data signals over a network;

a cover mounted to the outer casing of the electronic price label and including a front panel having a window and a holding mechanism, wherein the front panel of the cover covers a portion of a front surface of the outer casing of the electronic price label and the window in the front panel exposes the display screen of the electronic price label and a sensor on the electronic price label for sending and receiving the data signals over the network; and a marketing sign highlighting the electronic price label and including an opening defined by a perimeter, wherein a portion of the perimeter of the opening in the marketing sign engages with the holding mechanism of the cover and another portion of the perimeter of the opening in the marketing sign is located behind the front panel of the cover to secure the marketing sign.

2. The assembly of claim 1, wherein the holding mechanism of the cover comprises a channel that has an open top and extends along at least a portion of a top of the cover.

3. The assembly of claim 2, wherein the channel is defined by a support surface and a pair of legs, the pair of legs extending substantially normal to the support surface and the support surface being oriented substantially normal to a front face of the front panel of the cover.

4. The assembly of claim 2, wherein the portion of the perimeter of the opening in the marketing sign that engages with the holding mechanism of the cover is inserted into the channel of the cover.

5. The assembly of claim 2, wherein the perimeter of the opening in the marketing sign comprises a top edge, a bottom edge and a pair of opposing side edges, wherein the top edge of the perimeter of the opening is inserted into the channel of the cover.

6. The assembly of claim 5, wherein the bottom edge of the perimeter comprises a main portion and a tab portion that protrudes from the main portion and is continuous with the main portion.

7. The assembly of claim 6, wherein the opening comprises a first height that extends between the main portion of the bottom edge of the perimeter and the top edge of the perimeter and comprises a second height that extends between the tab portion of the bottom edge of the perimeter and the top edge of the perimeter, the first height being greater than the second height.

8. The assembly of claim 7, wherein the second height is less than a distance between a bottom of the channel and a bottom of the cover.

9. The assembly of claim 1, wherein the electronic price label comprises a bottom lip that protrudes from a bottom surface of the outer casing, wherein the portion of the marketing sign that is located behind the front panel of the cover is located between a back of the front panel of the cover and the bottom lip of the outer casing.

10. The assembly of claim 1, wherein the marketing sign further comprises a main section and a balloon section, the main section including the opening defined by the perimeter.

11. The assembly of claim 10, wherein the balloon section of the marketing sign is bent out-of-plane from the main section of the marketing sign along a bend.

12. The assembly of claim 1, wherein the cover further comprises a pair of side panels that extend backward from the front panel, each side panel including a lip that protrudes inwardly from the side panel to attach to a notch in the outer casing of the electronic price label.

13. A method of assembling a marketing information display assembly, the method comprising:

mounting a cover to an outer casing of an electronic price label, the cover including a front panel that covers a portion of a front surface of the outer casing of the electronic price label and a window in the front panel;

inserting an edge of a marketing sign into a channel in the cover, wherein the edge of the marketing sign defines a portion of an opening in the marketing sign; and pushing a remainder of the marketing sign to slide over the front panel of the cover so that a portion of the marketing sign is engaged with the channel in the cover and a portion of the marketing sign is positioned behind the front panel of the cover.

14. The method of claim 13, further comprising attaching the electronic price label to a front of a shelf in a retail store after the cover is attached to the outer casing of the electronic price label, but before the marketing sign is inserted into the channel and the remainder of the marketing sign is pushed over the front panel of the cover.

15. The method of claim 13, wherein pushing the remainder of the marketing sign to slide over the front panel of the cover comprises locating the remainder of the marketing sign between a bottom lip that protrudes from a bottom surface of the outer casing of the electronic price label and a back of the front panel of the cover.

16. The method of claim 13, further comprising bending the marketing sign so as to place a balloon section out-of-plane from a main section of the marketing sign, the opening being located in the main section of the marketing sign.

17. An assembly comprising:

an electronic price label having an outer casing;

a cover mounted to the outer casing of the electronic price label and including a front panel that covers a portion of a front surface of the outer casing and has a window; and a marketing sign having a first edge that is inserted into a channel on the cover and a second edge, wherein the first edge of the marketing sign defines a first portion of an opening in the marketing sign and the second edge defines a second portion of the opening in the marketing sign;

wherein the second edge of the marketing sign is slid over the front panel of the cover so that the first edge of the opening in the marketing sign is engaged with the channel in the cover and the second edge of the opening in the marketing sign is located behind the front panel of the cover.

18. The assembly of claim 17, wherein the second edge of the opening in the marketing sign defines a lower portion of the marketing sign and comprises a tab that protrudes from the second edge and is continuous with the second edge.

19. The assembly of claim 17, wherein the marketing sign further comprises a main section and a balloon section, wherein the main section includes the opening defined by the first edge and the second edge and the balloon section is bent out-of-plane from the main section of the marketing sign along a bend.

20. The assembly of claim 17, wherein the electronic price label comprises a bottom lip that protrudes from a bottom surface of the outer casing, wherein the second edge of the opening in the marketing sign that is located behind the front panel of the cover is located between a back of the front panel of the cover and the bottom lip of the outer casing.

* * * * *